US007671698B2

(12) United States Patent
Dupont et al.

(10) Patent No.: US 7,671,698 B2
(45) Date of Patent: Mar. 2, 2010

(54) WIDE-BAND DIRECTIONAL COUPLER

(75) Inventors: Francois Dupont, Tours (FR); Hilal Ezzeddine, Tours (FR)

(73) Assignee: STMicroelectronics S.A., Montrouge (FR)

( * ) Notice: Subject to any disclaimer, the term of this patent is extended or adjusted under 35 U.S.C. 154(b) by 185 days.

(21) Appl. No.: 11/807,507

(22) Filed: May 29, 2007

(65) Prior Publication Data

US 2007/0279147 A1 Dec. 6, 2007

(30) Foreign Application Priority Data

May 30, 2006 (FR) ..... 06 51948

(51) Int. Cl.
*H01P 5/18* (2006.01)
*H01P 1/20* (2006.01)
*H01P 3/08* (2006.01)

(52) U.S. Cl. ..... 333/109; 333/112; 333/116; 333/246

(58) Field of Classification Search ..... 333/109, 333/110, 111, 112, 113, 114, 115, 116, 238, 333/246

See application file for complete search history.

(56) References Cited

U.S. PATENT DOCUMENTS

| | | | | |
|---|---|---|---|---|
| 5,523,725 | A * | 6/1996 | Ishikawa et al. | 333/17.2 |
| 5,923,228 | A * | 7/1999 | Okada et al. | 333/109 |
| 6,150,898 | A | 11/2000 | Kushitani et al. | |
| 6,850,132 | B2 * | 2/2005 | Jun et al. | 333/202 |
| 7,026,887 | B2 * | 4/2006 | Watanabe et al. | 333/126 |
| 2005/0212617 | A1 | 9/2005 | Chen | |

OTHER PUBLICATIONS

French Search Report from French Patent Application 06/51948, filed May 30, 2006.

* cited by examiner

*Primary Examiner*—Dean O Takaoka
(74) *Attorney, Agent, or Firm*—Lisa K. Jorgenson; James H. Morris; Wolf, Greenfield & Sacks, P.C.

(57) ABSTRACT

A directional coupler having a first structure with distributed lines having a first conductive line intended to convey a main signal between two end terminals and having a second conductive line, coupled to the first one, intended to convey a secondary signal proportional to the main signal; and a second structure with local elements including, between a first terminal of the coupler intended to extract the secondary signal and a first end of the second line, two attenuators in series between which is interposed a low-pass filter and, between a second terminal of the coupler and the second end of the second line, at least one attenuator.

21 Claims, 2 Drawing Sheets

WIDE-BAND DIRECTIONAL COUPLER

BACKGROUND OF THE INVENTION

1. Field of the Invention

The present invention generally relates to the field of couplers which are intended to extract data proportional to a signal carried by a transmission line.

The present invention more specifically relates to couplers formed by means of conductive lines coupled to each other with no contact. Such couplers are called couplers with distributed lines as opposed to couplers with local elements, formed from capacitive and inductive elements.

The present invention more specifically applies to the field of radio-frequency couplers, for example, for radio-communication applications of mobile telephony type.

2. Discussion of the Related Art

FIG. 1 shows a conventional example of a coupler 10 with distributed lines. A main line 11 connects an input access IN to an output access DIR. Line 11 forms the primary of the coupler and is intended to convey the useful signal. A secondary line 12 is arranged parallel to line 11 to ensure a contactless coupling therewith to sample part of the power present on line 11. The two ends of line 12 define accesses, respectively CPLD intended to interpret the result of the coupling and ISO, generally isolated, that is, in the air. The coupler is typically formed by metal tracks deposited on an insulating substrate.

A distributed coupler is generally characterized by the following parameters:

the transmission losses between terminals IN and DIR;

the coupling, which corresponds to the transmission losses between terminals IN and CPLD;

the isolation of the coupling which corresponds to the transmission loss between terminals DIR and ISO; and the directionality, which represents the difference in decibels between the signals present on terminals ISO and CPLD.

The first three above parameters are generally measured while the two terminals not taken into account are loaded with standardized impedances (generally 50 ohms).

The lengths given to the main and secondary lines are calculated according to the central frequency of the passband for which the coupler is intended and to the desired coupling. Typically, these lines have lengths corresponding to one quarter of the wavelength of this central frequency. The longer the lines, the greater the insertion losses.

FIG. 2 very schematically shows, in the form of blocks, a radiofrequency transmission chain of the type to which the present invention applies as an example. A transmit amplifier 1 (PA) receives a radiofrequency signal RF to be transmitted by an antenna 2. To control the transmit power to a value, set by a reference REF, a coupler 10 with distributed lines between the output of amplifier 1 and antenna 2 is used. Accesses IN and DIR of main transmission line 11 are respectively connected to the output of amplifier 1 and to the input of antenna 2. Terminal CPLD of the coupled line is connected to the input of a detector 2 (DET) having its output compared (comparator 4) with reference signal REF to adjust the transmit power (the gain) of amplifier 1.

In a so-called directional coupler, a signal entering through terminal DIR is trapped by terminal ISO to avoid that this signal reaches the application, for example, amplifier 1 (FIG. 2). In this case, terminal ISO is generally loaded with a grounded 50-ohm impedance. "Higher directionality" is used to designate a greater attenuation in dB between accesses ISO and CPLD.

In other cases, an external isolator is provided between coupler 10 and antenna 2 to prevent a return of the signal to amplifier 1. The coupler then needs not be directional and terminal ISO is generally left in the air.

The present invention more specifically relates to directional couplers.

A disadvantage of couplers of the type illustrated in FIG. 1 is that the coupling is very sensitive to the frequency of the transmitted signal.

This disadvantage is particularly disturbing in radiocommunication applications more specifically aimed at by the present invention. Indeed, too high a variation of the coupling within the same operating frequency band (for example, GSM or DCS) adversely affects the optimization of the transmission chain operation. Further, the coupling may vary significantly from one frequency band to another.

A directional coupler is described, for example, in patent application No. US-A 2004/0113716 of the applicant. This coupler has interdigited transmission lines, and is also known as a Lange coupler. As compared with couplers with non-interdigited lines, a Lange structure enables improving the coupling between lines.

"Improvement in the coupling" is used to mean an increase in the attenuation in dB of the signal on terminal CPLD with respect to the desired signal to draw as little as possible from this signal.

"Improvement in the directionality" is used to mean an increase in the attenuation in dB of the signal on terminal ISO with respect to terminal CPLD.

Traditionally, to improve the directionality, capacitive elements are provided either between terminals of the coupler, or between some of these terminals and the ground.

A disadvantage is that, in frequency bands aimed at by the present invention, the values of the capacitive elements are so low that they become close to the values of the stray capacitances of the structure, which makes the coupler difficult to form.

SUMMARY OF THE INVENTION

The present invention aims at overcoming all or part of the disadvantages of known distributed line couplers.

The present invention more specifically features keeping a low coupling substantially constant over a wide band while maintaining a good directionality.

To achieve all or part of these objects, as well as others, the present invention provides a directional coupler, comprising:

a first structure with distributed lines having a first conductive line intended to convey a main signal between two end terminals and having a second conductive line, coupled to the first one, intended to convey a secondary signal proportional to the main signal; and a second structure with local elements comprising, between a first terminal of the coupler intended to extract the secondary signal and a first end of the second line, two attenuators in series between which is interposed a low-pass filter and, between a second terminal of the coupler and the second end of the second line, at least one attenuator.

According to an embodiment of the present invention, said structure with local elements comprises, on the side of the second end of the second line, two attenuators between which is arranged a low-pass filter.

According to an embodiment of the present invention, the low-pass filter(s) exclusively comprise a conductive planar winding.

According to an embodiment of the present invention, said attenuators are each formed of an assembly of resistive elements providing input/output impedances equal to a reference impedance.

According to an embodiment of the present invention, said assemblies are "π" assemblies.

According to an embodiment of the present invention, said structure with distributed lines is a Lange structure.

According to an embodiment of the present invention, no element comprises a capacitive element, except for possible stray capacitances.

The present invention also provides a radio-frequency transmission chain comprising, between a transmit amplifier and a connection to an antenna, a directional coupler.

The foregoing and other objects, features, and advantages of the present invention will be discussed in detail in the following non-limiting description of specific embodiments in connection with the accompanying drawings.

DETAILED DESCRIPTION

Figure 1:
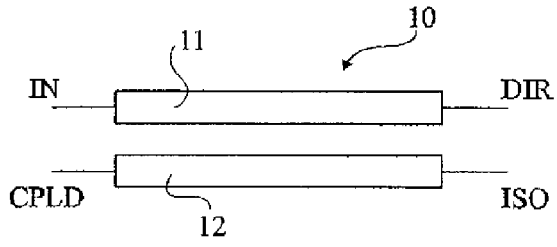
Fig 1 (Prior Art)
FIG. 1, previously described, schematically shows a conventional distributed coupler.

The same elements have been designated with the same reference numerals in the different drawings which have been drawn out of scale. For clarity, only those elements which are useful to the understanding of the present invention have been shown in the drawings and will be described hereafter. In particular, the signals crossing the coupler as well as what exploitation is made of the measurements by the coupled line have not been detailed, the present invention being compatible with any conventional application of such signals.

A feature of an embodiment of the present invention is to combine a structure with distributed lines of Lange structure type with a structure with local elements comprising at least one low-pass filter in series with the secondary line of the distributed structure.

Figure 2:
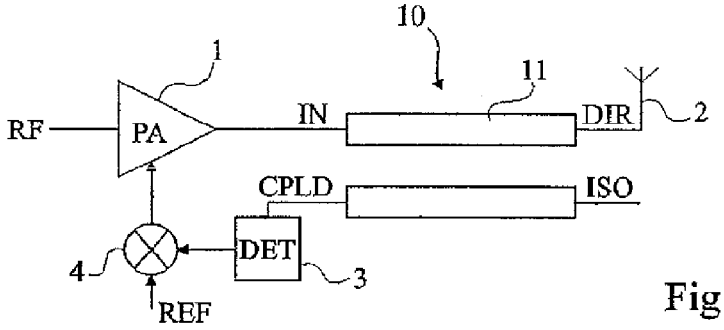
FIG. 2, previously described, shows an example of application of a coupler of the type to which the present invention applies.

FIG. 2 shows the diagram of an embodiment of a coupler according to the present invention.

This coupler comprises a structure 20 with distributed lines associated with a structure 30 with local elements, the combination of the two structures forming the coupler as a whole.

Figure 3:
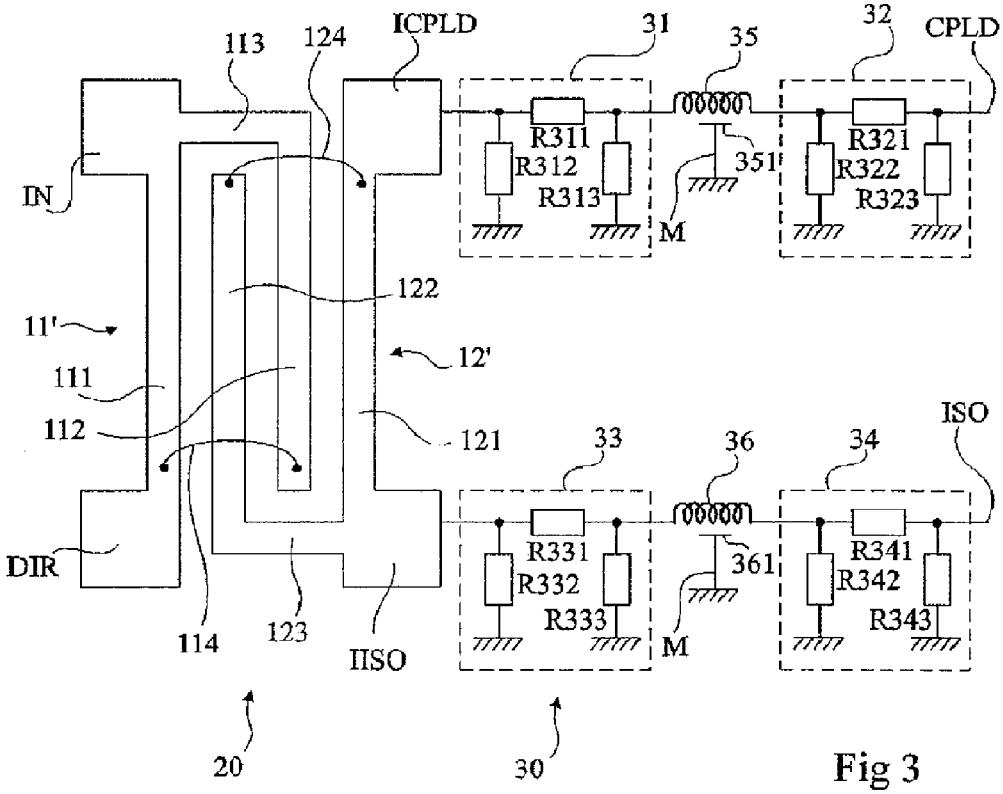
FIG. 3 very schematically shows a first embodiment of a directional coupler according to the present invention.

Structure 20 has the form of a Lange structure in which lines 11' and 12' are interdigited. In the example of FIG. 3, each line comprises two parallel rectilinear sections 111 and 112, respectively 121 and 122. Section 111 connects accesses IN and DIR of the coupler. Section 121, parallel to section 111, connects internal accesses ICPLD and IISO of the structure with distributed lines. Between sections 111 and 121 are successively arranged section 122, then section 112, to obtain the interdigited structure. Sections 111 and 112 are connected by a perpendicular section 113 on the side of access IN. A perpendicular connection section 123 connects the ends of sections 121 and 122 on the side of access IISO. Finally, conductive sections (bridges) 114 and 124 connect the respective free ends of sections 112 and 122 to accesses DIR and ICPLD, respectively. In an embodiment using the integrated circuit technologies to which the present invention applies, connections 114 and 124 are formed by vias (not shown) and conductive tracks in a second conductive level with respect to a level in which are formed, in a plane, tracks 111, 112, 113, 121, 122, and 123 as well as access pads IN, DIR, ICPLD, and IISO.

Structure 30 with local elements is formed, between access ICPLD and a terminal CPLD of the coupler intended to be connected to the application (for example to a detector 3 of the type illustrated in FIG. 2), of two attenuators 31 and 32 between which is interposed a low-pas filter 35. Each attenuator 31, 32 is for example formed of a π (pi) assembly of three resistive elements R311, R312 and R313, respectively R321, R322, and R323. Resistive element R311 connects access ICPLD to a first end of inductive element 33 having its other end connected to terminal CPLD by resistor R321. Each resistive element R312, R313, R322, or R323 connects a terminal of one of resistors R311 and R321 to ground M. Low-pass filter 35 is for example formed of an inductive element formed by a planar winding of a conductive track on an insulating support having its other surface comprising, preferably, a ground plane M. The presence of this ground plane under the inductive element has been illustrated in FIG. 3 by an electrode 351 connected to ground M. The insulating support may be the same substrate as that receiving structure 20.

An identical assembly is reproduced between terminal IISO of Lange structure 20 and a final terminal ISO of the coupler. It comprises two attenuators 33 and 34 formed of resistive elements R331, R332, and R333, respectively R341, R342, and R343, and a low-pass filter 36 formed of an inductive element preferably in the form of a planar conductive track having an underlying ground plane illustrated by a grounded electrode 361.

Structure 20 with distributed lines creates the isolation between transmission line 11' and coupled line 12'.

The presence of attenuators 31 and 32 decreases the coupling power while the low-pass filter brings the frequency stability. A low-pass filter of first order is sufficient in the applications aimed at by the present invention.

The fact of providing two attenuators on either side of filter 35 enables preserving the impedance matching in both directions (seen from the coupler and seen from the detector).

In the embodiment of FIG. 3, terminal ISO is for example intended to be connected to a second detector, which justifies the presence of low-pass filter 36 and of the two attenuators 33 and 34. The presence of the two attenuators takes part in the obtaining of a low coupling factor (significant attenuation) while maintaining a high directionality.

An advantage of the combination of the two structures 20 and 30 is that it enables sizing the Lange structure for a coupling of a relatively high factor, which does not impose too low dimensions and preserves acceptable insertion losses. This structure becomes easily implementable while maintaining a good directionality. The attenuation complement of the coupled path is then provided by the attenuators.

The quality factor of inductive elements 35 and 36 is not critical for the implementation of the present invention since these inductances are placed on the coupled and isolated paths. Further, the inductive elements being located on the attenuated path (secondary line) with respect to the main transmission line, a possible coupling between the two inductive elements will remain negligible.

Figure 4:
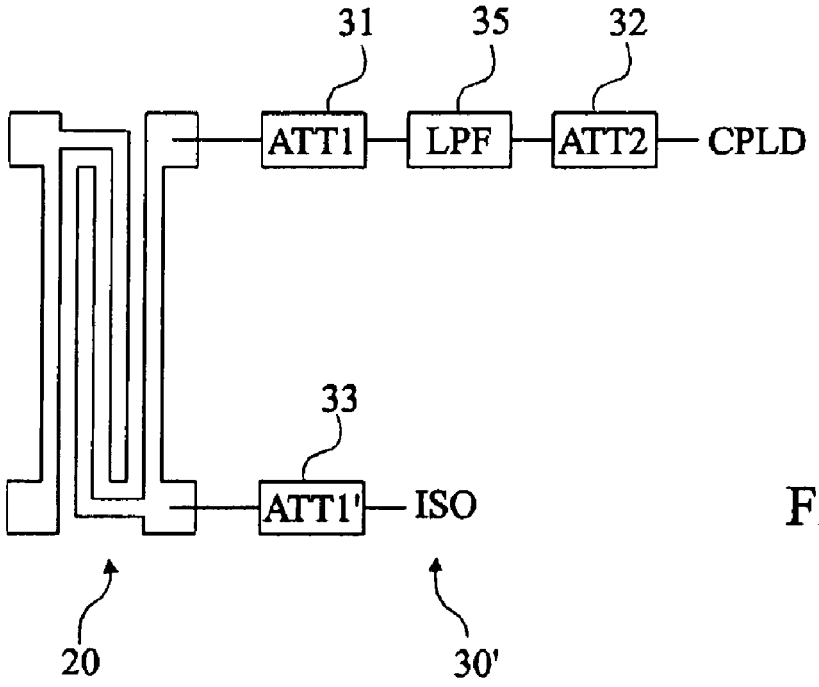
FIG. 4 schematically shows in the form of blocks a second embodiment of a directional coupler according to the present invention.

FIG. 4 schematically shows in the form of blocks a second embodiment of a coupler according to the present invention. As compared with FIG. 3, the difference is that structure 30' with local elements comprises, on the side of terminal ISO, only one attenuator 33 (ATT1'). Such an assembly is more specifically intended for the case where only terminal CPLD is loaded with a detector. Terminal ISO is then grounded via a 50-ohm load (or the reference impedance). It will be ascertained not to directly ground terminal ISO, failing which the coupler would no longer be directional.

As compared with the assembly of FIG. 4, FIG. 3 has the advantage of a symmetrical structure. It however requires adding one inductance and three resistors.

An advantage of the coupler of the present invention is that it comprises no capacitive element (other than possible stray capacitances such as, for example, between the tracks forming the inductances of filters 35 and 36 and electrodes 351 and 361). This makes the structure robust against electrostatic discharges (ESD) without requiring any additional protection.

Another advantage of the coupler of the present invention is to decrease the ripple of the coupling factor in each band as well as from one band to another in an application to several frequency bands with respect to conventional couplers. This further enables using a single coupler.

As a comparison, a coupler of the type illustrated in FIG. 3 has been formed for frequencies ranging from approximately 800 MHz to 2 GHz by obtaining a −40 dB coupling and a −30 dB directionality, to be compared with a −20 dB coupling and a −25 dB directionality in the conventional case (Lange coupler alone).

Further, the variation of the coupling factor from one band to another between the GSM band (approximately 200 MHz around 900 MHz) and the DCS (approximately 200 MHz around 1.8 GHz) decreases from 12 dB to less than 2 dB.

In each band, the coupling factor variation decreases from 1 dB to less than 0.3 dB.

As a specific example of embodiment, a coupler according to the present invention intended for the GSM and DCS bands has been formed with the following dimensions and components:

lange structure with distributed lines of a total length of approximately 1.7 mm (developed length of each line: approximately 3.5 mm);

inductive elements 35 and 36 formed by 4.5-mm planar conductive windings;

resistors R311, R321, R331, and R341: 70Ω; and resistors R312, R313, R322, R323, R332, R333, R342, and R343: 60Ω.

Such a coupler exhibits a total bulk of 1.8 by 1.2 $mm^2$ when it is formed by using technologies of the type used for the integrated circuit manufacturing.

Of course, the present invention is likely to have various alterations, modifications, and improvements which will readily occur to those skilled in the art. In particular, the structure with distributed lines may be more complex (more interdigited branches) or, conversely, a non-interdigited distributed structure. Further, the dimensions of the different elements used by the present invention are within the abilities of those skilled in the art based on the functional indications given hereabove and according to the aimed application. Further, although resistive π attenuators form a preferred embodiment, other assemblies with local elements may be provided, for example, any "T" attenuation structure or other, ensuring a 50-ohm matching (or other reference impedance) on either side of the attenuation structure.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A directional coupler, comprising:

a first structure with distributed lines having a first conductive line intended to convey a main signal between two end terminals and having a second conductive line, coupled to the first one, for conveying a secondary signal proportional to the main signal; and a second structure with local elements comprising, between a first terminal of the coupler for extracting the secondary signal and a first end of the second line, two attenuators in series between which is interposed a low-pass filter and, between a second terminal of the coupler and the second end of the second line, at least one attenuator.

2. The coupler of claim 1, wherein said structure with local elements comprises, on the side of the second end of the second line, two attenuators between which is arranged a low-pass filter.

3. The coupler of claim 1, wherein the low-pass filter(s) exclusively comprise a conductive planar winding.

4. The coupler of claim 1, wherein said attenuators are each formed of an assembly of resistive elements providing input/output impedances equal to a reference impedance.

5. The coupler of claim 4, wherein said assemblies are "π" assemblies.

6. The coupler of claim 1, wherein said structure with distributed lines is a Lange structure.

7. The coupler of claim 1, wherein no element comprises a capacitive element, except for possible stray capacitances.

8. A radio-frequency transmission chain comprising, between a transmit amplifier and a connection to an antenna, a coupler according to claim 1.

9. A distributed coupler, comprising:

a first distributed conductive line;

a second distributed conductive line coupled to the first distributed conductive line to sample a signal on the first distributed conductive line;

a first attenuator coupled to the second distributed conductive line;

a low-pass filter coupled to the first attenuator; and a second attenuator coupled to the low-pass filter and a terminal of the distributed coupler.

10. The distributed coupler of claim 9, wherein the first attenuator is coupled to a first terminal of the second distributed conductive line, and wherein the distributed coupler further comprises:

a third attenuator coupled to a second terminal of the second distributed conductive line.

11. The distributed coupler of claim 10, further comprising:

a second low-pass filter coupled to the third attenuator; and a fourth attenuator coupled to the second low-pass filter and a second terminal of the distributed coupler.

12. The distributed coupler of claim 9, wherein one or more of the first and second attenuators comprises a pi resistor network.

13. The distributed coupler of claim 9, wherein the low-pass filter comprises a conductive planar winding.

14. The distributed coupler of claim 9, wherein the first and second distributed conductive lines form a Lange structure.

15. The distributed coupler of claim 9, wherein the first distributed conductive line conducts a main signal to be transmitted by an antenna.

16. A distributed coupler, comprising:

a first distributed conductive line;

a second distributed conductive line coupled to the first distributed conductive line to detect a signal on the first distributed conductive line;

a first attenuator coupled to a first terminal of the second distributed conductive line, the first attenuator comprising a pi resistor network; and a second attenuator coupled to a second terminal of the second distributed conductive line, the second attenuator comprising a second pi resistor network.

17. The distributed coupler of claim 16, further comprising:

a low-pass filter coupled to the first attenuator.

18. The distributed coupler of claim 17, further comprising:

a third attenuator coupled to the low-pass filter and a terminal of the distributed coupler.

19. A component network for a distributed coupler, the component network comprising:

a first attenuator to receive a signal from a first terminal of a distributed conductive line of the distributed coupler;

a second attenuator; and a low-pass filter coupled between the first attenuator and the second attenuator.

20. The component network of claim 19, further comprising:

a third attenuator coupled to a second terminal of the distributed conductive line.

21. The component network of claim 20, further comprising:

a fourth attenuator coupled to a terminal of the distributed coupler; and a second low-pass filter coupled between the third attenuator and the fourth attenuator.

* * * * *